US011331773B2

(12) United States Patent
Wu

(10) Patent No.: US 11,331,773 B2
(45) Date of Patent: May 17, 2022

(54) RAPID RATCHET WRENCH CAPABLE OF BEING USED IN ONE HAND

(71) Applicant: NINGBO S-CHANDE IMPORT&EXPORT CO., LTD., Ningbo (CN)

(72) Inventor: Weijun Wu, Ningbo (CN)

(73) Assignee: NINGBO S-CHANDE IMPORT & EXPORT CO., LTD., Ningbo (CN)

( * ) Notice: Subject to any disclaimer, the term of this patent is extended or adjusted under 35 U.S.C. 154(b) by 0 days.

(21) Appl. No.: 15/734,888

(22) PCT Filed: Jul. 8, 2019

(86) PCT No.: PCT/CN2019/095111
§ 371 (c)(1),
(2) Date: Dec. 3, 2020

(87) PCT Pub. No.: WO2020/151198
PCT Pub. Date: Jul. 30, 2020

(65) Prior Publication Data

US 2021/0220972 A1 Jul. 22, 2021

(30) Foreign Application Priority Data

Jan. 23, 2019 (CN) ..... 201910065640.3

(51) Int. Cl.
*B25B 13/46* (2006.01)

(52) U.S. Cl.
CPC ..... *B25B 13/46* (2013.01)

(58) Field of Classification Search
USPC ..... 81/60, 62, 61, 63–63.2; D8/25
See application file for complete search history.

(56) References Cited

U.S. PATENT DOCUMENTS 1,798,194 A * 3/1931 Dodge ..... B25B 13/463 81/62
4,277,989 A * 7/1981 Tracy ..... B25B 13/463 192/43.1

(Continued)

FOREIGN PATENT DOCUMENTS

CN 201760830 U 3/2011
CN 107486804 A 12/2017

(Continued)

OTHER PUBLICATIONS

International Search Report (International Application No. PCT/CN2019/095111); dated Oct. 28, 2019; 5 pages; Includes English Translation.

*Primary Examiner* — Joseph J Hail
*Assistant Examiner* — Jonathan R Zaworski

(57) ABSTRACT

A rapid ratchet wrench capable of being used in one hand comprises a handle, a wrench head, pawls, and a tensioner head, wherein the wrench head is arranged at the top end of the handle, and a left pawl and a right pawl are arranged at positions close to the handle in a sleeve hole. The tensioner head is mounted at the top end of a control mechanism, and a propelling head is arranged at the tail end of the control mechanism; and the adjacent sides of the left pawl and the right pawl are respectively provided with a touch head in a staggered manner, the tensioner head can respectively touch one of the touch heads and ejects the corresponding pawl to make same open outwards, and the other touch head is in the working position.

11 Claims, 3 Drawing Sheets

(56) References Cited

U.S. PATENT DOCUMENTS

| | | | | |
|---|---|---|---|---|
| 4,589,307 | A * | 5/1986 | Parker | B25B 13/463 81/62 |
| 4,869,138 | A | 9/1989 | Farris | |
| 5,622,089 | A * | 4/1997 | Gifford, Sr. | B25B 13/462 192/43.1 |
| 5,642,794 | A | 7/1997 | Chuang et al. | |
| 5,687,820 | A | 11/1997 | Lin | |
| 5,836,430 | A | 11/1998 | Vasudeva | |
| 7,954,402 | B2 * | 6/2011 | Crawford | B25B 23/0035 81/177.85 |

FOREIGN PATENT DOCUMENTS

| | | | |
|---|---|---|---|
| CN | 207606737 | U | 7/2018 |
| CN | 109732520 | A | 5/2019 |

* cited by examiner

RAPID RATCHET WRENCH CAPABLE OF BEING USED IN ONE HAND

CROSS-REFERENCE TO RELATED APPLICATIONS

This application is a national phase application of International Patent Application No. PCT/CN2019/095111, filed Jul. 8, 2019, which claims priority to CN Patent Application No. 201910065640.3, filed Jan. 23, 2019, the disclosures of which are hereby incorporated by reference in their entirety.

TECHNICAL FIELD

The present invention relates to the technical field of hardware tools and is specifically a rapid ratchet wrench capable of being used in one hand.

BACKGROUND ART

Ratchet wrench is a wrench tool that drives the rotating of nut in forward rotation, and makes the pawl slide relative to the nut in reverse rotation with the nut not rotated. In case of ratchet wrenches with two pawls available on the market, a tensioner head is provided between two pawls. When in use, its handle is held in one hand with the tensioner head rotated with the aid of the other hand, so that the tensioner head can respectively push the left or right pawl, until one of the pawls is in the working position. This two-handed method of operation results in a non-optimal working efficiency.

SUMMARY OF THE INVENTION

The object of the present invention is to provide a rapid ratchet wrench capable of being used in one hand. User can adjust the working state of each pawl at any time when holding the wrench. This process can be done in one hand with user-friendly and better working efficiency feature.

To achieve the above object, the present invention provides technical solutions as follows: a rapid ratchet wrench capable of being used in one hand comprising a handle, a wrench head, pawls, and a tensioner head, wherein the wrench head is arranged at the top end of the handle, and a left pawl and a right pawl are arranged at positions close to the handle in a sleeve hole. A pawl can deflect around its rear end, a spring is arranged between the pawl and the wall surface of the sleeve hole, and the said tensioner head is arranged between the left pawl and the right pawl. The tensioner head is mounted at the top end of a control mechanism, and a propelling head is arranged at the tail end of the control mechanism; the control mechanism can move back and forth after pushing the propelling head, so that the tensioner head is located in front and rear positions; the adjacent sides of the left pawl and the right pawl are respectively provided with a touch head in a staggered manner, when the tensioner head is located in front and rear positions, it can respectively touch one of the touch heads and ejects the corresponding pawl to make same open outwards, and the other touch head is in the working position.

According to the technical solution as described above, the tensioner head which functions as controlling the left pawl and the right pawl is mounted at the top end of the control mechanism, the said control mechanism can move back and forth to control the forward or reverse movement of the tensioner head. In case of forward or reverse movement, the tensioner head will independently touch one of the touch heads that are disposed on the pawl, push this touch head to deflect outwards, then its corresponding pawl is deflected outwards, the other pawl is freely disposed in the working position. At this point, the pawl in the working position can make the nut rotate; when gripping the handle, the tensioner head can move and eject the other pawl as long as the propelling head is in reverse movement. At this point, the first pawl is in the working position, and the nut can be rotated reversely. In this regard, this wrench is capable of adjusting the pawl with one hand, so that the forward and reverse rotation of the nut can be achieved.

Preferably, the said handle is internally provided with an inner hole, the control mechanism is mounted in the inner hole, a through hole is provided at the area where the handle is joined to the wrench head, which connects the inner hole through the sleeve hole, and the control mechanism runs across this through hole. The said control mechanism is mounted in the inner hole that is arranged in the middle part of the handle, which can protect the control mechanism against unexpected damage, and avoid the interiors of the control mechanism from depositing dust or other objects that may undermine its free movement.

Preferably, a movable hole connecting through the inner hole is disposed on the side wall of the handle, the said propelling head runs across the movable hole and is arranged outside the handle. When gripping the handle, fingers can easily push the propelling head, which makes it good for operation and allows for the best hand grip.

Preferably, the said control mechanism comprises a top shaft and a positioning mechanism. The tensioner head is mounted on the top end of the top shaft and its position can be secured by means of the positioning mechanism. This wrench can be used in two states: counterclockwise rotation and clockwise rotation. Throughout the process of one state, two pawls need to be stable. In other words, the tensioner head should remain in a relatively stationary position, and its position can be located by setting the positioning mechanism, so that the wrench is more user-friendly.

Preferably, the said positioning mechanism is a ratchet retractable mechanism comprising a pressing head, a rotating head, a guide strip and a return spring. The rotating head is joined to the top shaft, the said return spring is nested on the top shaft, with one end against the body of the handle and the other end against the block bar disposed on the top shaft; the said propelling head is provided on the pressing head. When this ratchet retractable mechanism is used, the entire control mechanism can be adjusted by only pushing the propelling head, which features user-friendly and fault-free operation.

Further, the said guide strip is arranged on the inner wall of the inner sleeve, the inner sleeve is mounted in the inner hole, the front end of the inner sleeve is provided with a hole allowing the top shaft to run across, and the said pressing head and rotating head are inserted in the inner sleeve. The guide strip in the ratchet retractable mechanism is arranged inside the inner sleeve, and the pressing head and rotating head are nested in the inner sleeve. This arrangement can make it easier for the mounting and dismounting of all the components of the ratchet retractable mechanism, and facilitate the mass production, disassembly and repair service of this ratchet wrench.

Further, a screw hole connecting through the inner hole is disposed on the handle, and a positioning bolt that functions as securing the inner sleeve is mounted in the screw hole.

The inner sleeve can be securely fixed in the inner hole by tightening the positioning bolt, so that the inner sleeve can avoid from swaying.

BRIEF DESCRIPTION OF THE DRAWINGS

The drawings as described herein are intended to provide a further understanding of, and constitute a part of the present application. The exemplary embodiments and descriptions of the present application are intended to explain the present application, rather than constitute an improper limitation on it. In these drawings.

Figure 1:
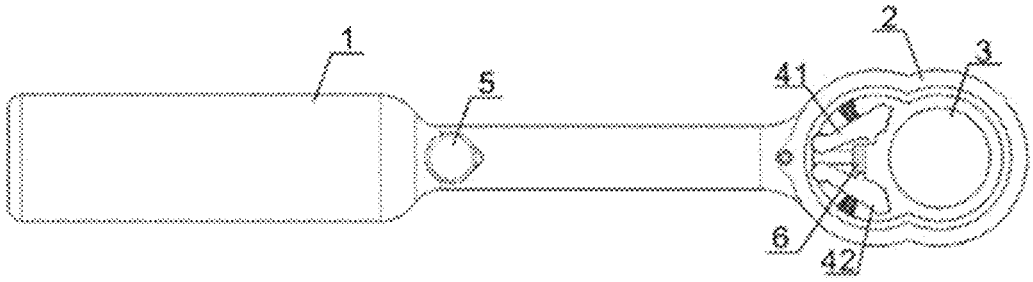
FIG. 1 is a front view of the present invention.
Figure 2:
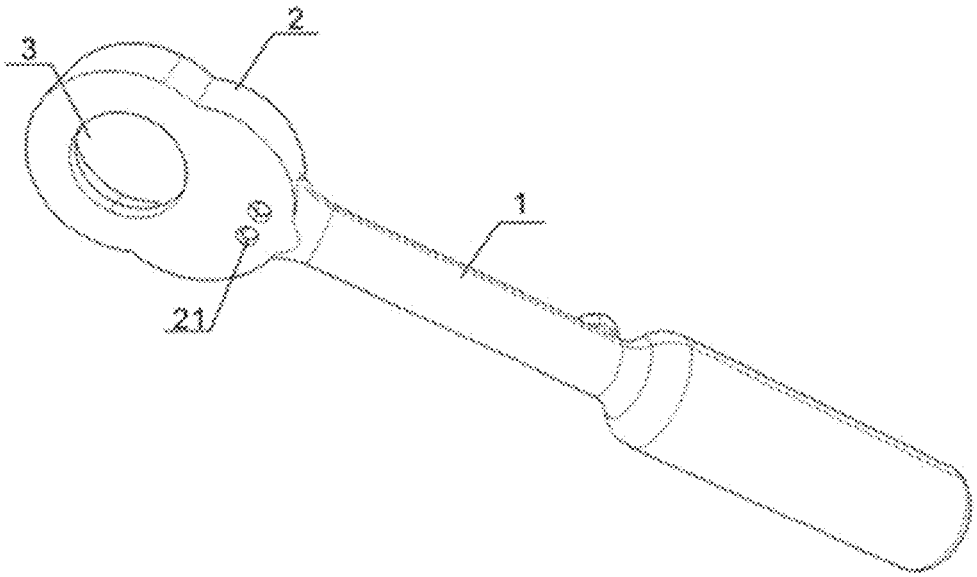
FIG. 2 is a back perspective view of the present invention.

In these drawings, the handle 1, the wrench head 2, the sleeve hole 3, the left pawl 41, the right pawl 42, the propelling head 5, the tensioner head 6, the spring 7, the control mechanism 8, the positioning bolt 9, the inner hole 10, the nut 11, the positioning hole 21, the top shaft 81, the pressing head 82, the rotating head 83, the guide strip 84, the return spring 85, the block bar 86, the inner sleeve 87, the movable hole 101, and the contact head 400.

DESCRIPTION OF THE PREFERRED EMBODIMENTS

Referring to the accompanying drawings and embodiments, the mode of carrying out the present application will be described in details below, in order to fully understand how this application uses technical means to solve technical problems and achieve technical outcome, and to carry out this application accordingly.

Referring to FIGS. 1-3 and FIG. 6, the present invention provides an embodiment: the existing ratchet wrench 20 functions as the general body, the wrench head 2 is arranged at the top end of the handle 1, the front face of the wrench head 2 is provided with a groove whose front part is provided with a sleeve hole 3, and the left pawl 41 and the right pawl 42 are arranged at positions close to the handle in the groove. The positioning hole is provided at the rear part of the bottom of the groove, a rotating shaft is arranged the ends of the left and right pawls which are mounted in the positioning hole 21 by the rotating shaft, and the said two pawls can deflect around their respective rotating shafts. Moreover, the spring 7 is arranged between the pawl and the groove walls, the said tensioner head is arranged between the left pawl 41 and the right pawl 42. The tensioner head 6 is mounted at the top end of the top shaft 81 which is disposed on the handle 1, and a positioning mechanism is disposed at the tail end of the top shaft 81. The propelling head 5 is arranged on the said positioning mechanism, which can be pushed to move the control mechanism 8 back and forth, and keep the tensioner head 6 stationary at the front or rear part; the adjacent sides of the said left pawl and the right pawl are respectively provided with a touch head in a staggered manner, and the left touch head 400 is placed ahead of the right touch head 400. If disposed in the front part, the tensioner head 6 will push the left touch head 400 to move and shift the left pawl 41 leftwards; if disposed in the rear part, the tensioner head 6 will push the right touch head 400 to move and shift the right pawl 42 rightwards; at the point, the left pawl 41 is in the working position.

Also, the handle 1 is provided with an inner hole 10 inside which runs across the entire body of the handle 1, and a plug is arranged at the tail end of the handle 1, which can seal the inner hole port to prevent foreign matters from entering the inner hole 10. The top shaft 81 and the positioning mechanism are mounted in the inner hole 10, a through hole 103 is provided at the area where the handle 1 is joined to the wrench head 2, which connects the inner hole 10 through the sleeve hole 3, and the top shaft 81 runs across the said through hole 103. A movable hole 101 connecting through the inner hole is disposed on the side wall of the handle, the said propelling head 5 runs across the movable hole 101 and is arranged outside the handle 1. When gripping the handle 1, fingers can easily push the propelling head 5 to move.

Figure 4:
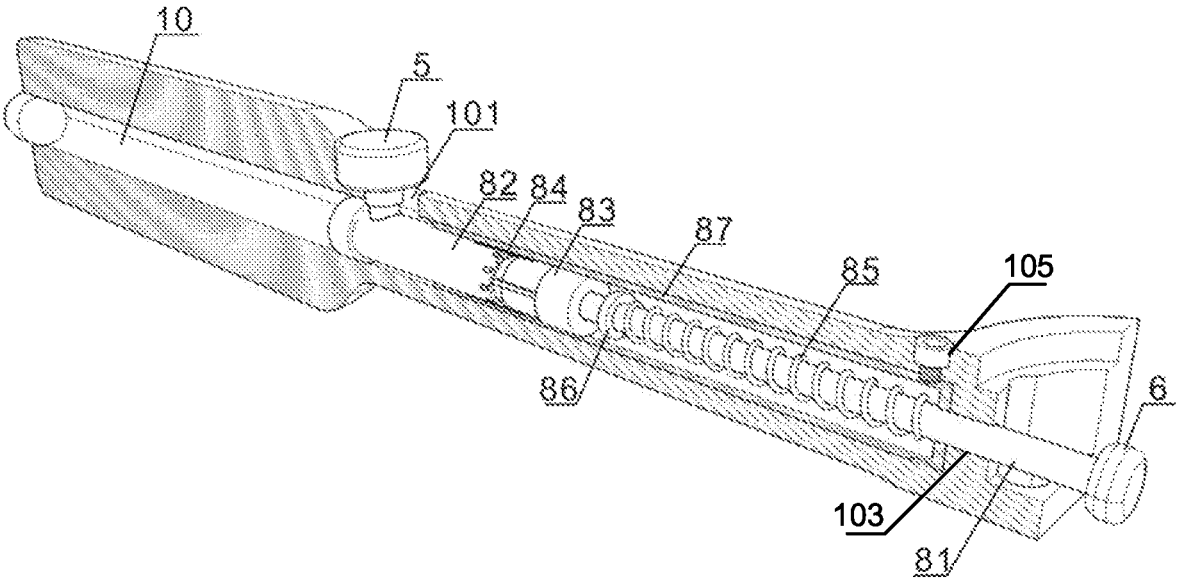
FIG. 4 is a schematic diagram of the mounting structure of the control mechanism inside the handle of the present invention.
Figure 5:
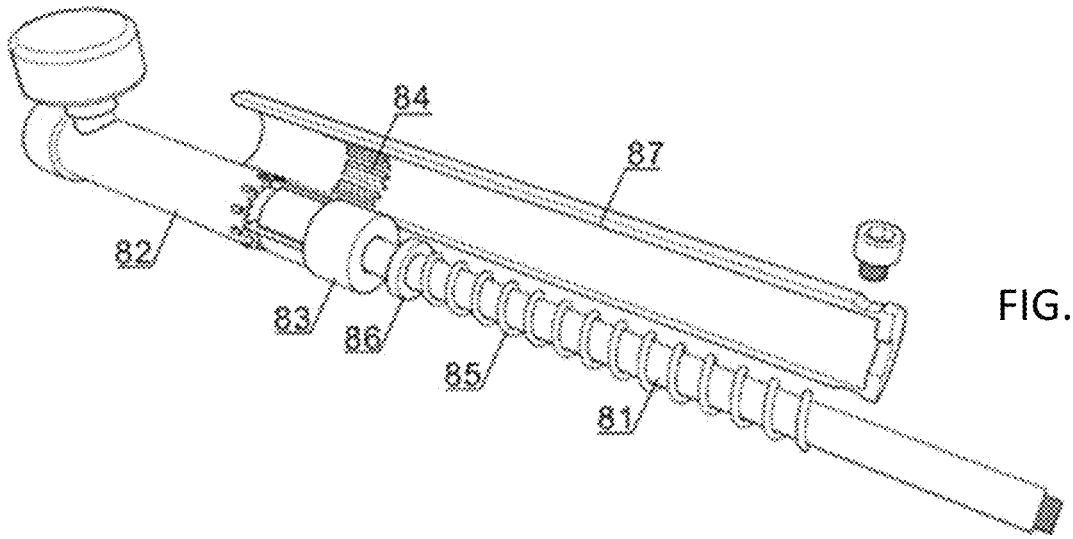
FIG. 5 is a schematic diagram of the exploded structure of the control mechanism inside the handle of the present invention.
Figure 6:
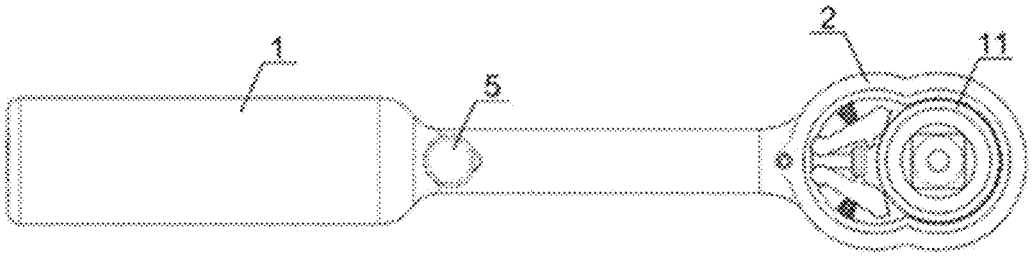
FIG. 6 is a front view of the present invention when in use.

The positioning mechanism in use is a ratchet retractable mechanism (namely the retractable mechanism of an auto ballpoint pen), referring to FIGS. 4 and 5, comprising a pressing head 82, a rotating head 83, a guide strip 84 and a return spring 85. The rotating head 83 is joined to the top shaft 81, with one end of the return spring 85 against the body of the handle 1 and the other end against the block bar 86 disposed on the top shaft 81; the said propelling head 5 is provided on the pressing head 82. When this ratchet retractable mechanism is used, the position of the propelling head 5 can be adjusted by only pushing the propelling head 5, which features user-friendly and fault-free operation.

In the ratchet retractable mechanism, the said guide strip 84 is arranged on the inner wall of the inner sleeve 87, the inner sleeve 87 is mounted in the inner hole, the front end of the inner sleeve is provided with a hole allowing the top shaft 81 to run across, and the said pressing head 82 and rotating head 83 are inserted in the inner sleeve 87. The guide strip 84 in the ratchet retractable mechanism is arranged inside the inner sleeve 87, and the pressing head 82 and rotating head 83 are nested in the inner sleeve 87. This arrangement can make it easier for the mounting and dismounting of all the components of the ratchet retractable mechanism, and facilitate the mass production, disassembly and repair service of this ratchet wrench.

Figure 3:
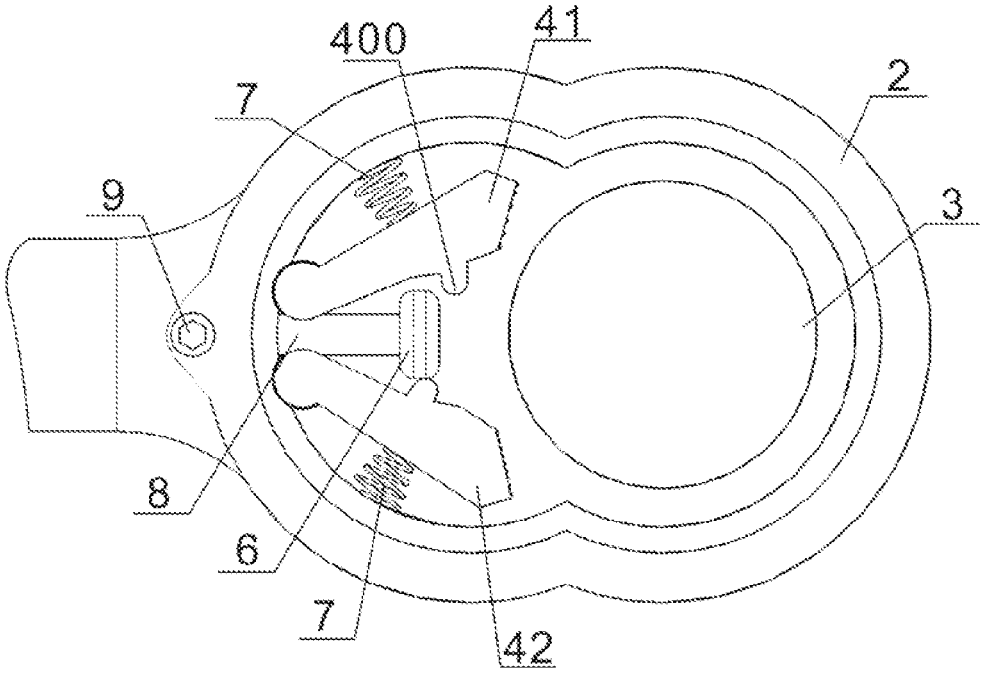
FIG. 3 is a schematic plan view of the wrench head of the present invention.

To ensure the stability of the inner sleeve 87, a screw hole 105 connecting through the inner hole 10 is disposed on the handle 1, referring to FIG. 3 and 4, a positioning bolt 9 that functions as securing the inner sleeve 87 is mounted in the screw hole 105, and an annular groove is provided at the front end of the inner sleeve, the top end of the positioning bolt 9 touches the said annular groove to prevent the inner sleeve 87 from moving backwards.

How it works: illustrating the clockwise rotation of the wrench as an example, nest the sleeve hole 3 on the nut 11, push the propelling head 5 to make the tensioner head 6 move backwards. At this point, the right pawl 42 deflects rightwards and the left pawl 41 contacts the nut 11. Push the handle 1 counterclockwise, the left pawl 41 is tightly against the side walls of the nut 11, so that the nut 11 rotates. Turn back the handle 1 counterclockwise, the nut 11 stays put, the left pawl 11 slides relative to the side walls of the nut 11, then turn the wrench clockwise and turn the nut 11.

For the present invention, the control mechanism that is arranged inside the handle is used to control the position of the tensioner head, then to control the position of two pawls respectively, so that the wrench is suitable for the process of nut tightening and loosening. When gripping the handle, the position of the tensioner head can be readily adjusted and located by pushing the propelling head with fingers. The ratchet wrench, featuring user-friendly process, is capable of being used in one hand and makes it convenient to work.

Some works are referred to in the specification and claims of the present invention to indicate specific components. Those skilled in the technical art should understand that hardware manufacturer may refer to the same component with different terms. In this specification and claims, components are differentiated by using the difference in function as a criterion, instead of the difference in name. For example, "include" as referred to in the full text of specification and claims is an open term, which should be construed as "including but not limited to". "Approximately" means that those skilled in the technical art are able to solve the said technical issues and generally achieve the technical outcome within the error limit to the extent acceptable. In addition, "coupled" herein includes any direct and indirect electrical coupling means. Therefore, if the first device is coupled to the second device as described in the specification, it shall mean that the first device can be directly coupled to the second device, or indirectly coupled to the said second device by means of other devices or coupling means. The subsequent description of the specification is a preferred embodiment for carrying out the present application. However, the said description is intended to account for the general principles of the present application, rather than limit the scope of the application. The extent to which the present application is protected shall be subject to those defined in the attached claims.

It should be noted that "include", "including" or any of other variations is intended to cover non-exclusive inclusions, so that a commodity or system that includes a series of elements not only includes those elements, but also those that are not explicitly listed, or certain elements inherent to this commodity or system. Without more restrictions, the elements defined by the sentence "including a . . . " shall not exclude that there are other identical elements in the commodity or system including the said elements.

The above description illustrates and describes a plurality of preferred embodiments of the present invention, but as referred to above, it should be understood that the present invention is not limited to the form as disclosed herein, which shall not be seen as the exclusion of other embodiments, but can be used for a variety of other combinations, modifications, and environments, and may be modified by the above instructions or technology or knowledge in related fields to the extent conceived as referred to herein. Any modification and change made by those skilled in the technical art, which are not deviated from the spirit and scope of the present invention, shall be included as a part of protection under the claims attached herein.

What is claimed is:

1. A rapid ratchet wrench capable of being used in one hand comprising:

a handle;

a wrench head arranged at a top end of the handle and having a sleeve hole, with a sleeve wall having a wall surface;

a left pawl and a right pawl arranged at positions adjacent to the handle within the sleeve hole, each of the left and right pawls being configured to deflect around its respective rear end;

a spring arranged between each one of the left and right pawls and the wall surface of the sleeve hole; and a control mechanism having a tensioner head mounted at a top end of the control mechanism and a propelling head arranged at a tail end of the control mechanism, the tensioner head being arranged between the left pawl and the right pawl;

wherein the control mechanism is moveable towards and away from the wrench head in response to movement of the propelling head, so that the tensioner head is moveable between front and rear positions, wherein adjacent sides of the left pawl and the right pawl are each provided with a touch head in a staggered manner, wherein when the tensioner head is located in the front or rear position, the tensioner head is in contact with the touch head of a corresponding one of the left and right pawls and ejects the corresponding one of the left and right pawls to open outwards, and wherein the other one of the left and right pawls is in a working position.

2. A rapid ratchet wrench capable of being used in one hand as set forth in claim 1, wherein the handle is internally provided with an inner hole which spans a length of the handle, the control mechanism is mounted in the inner hole, a through hole is provided at an area where the handle is joined to the wrench head, wherein the inner hole is in communication with the sleeve hole through the through hole, and the control mechanism passes through the through hole.

3. A rapid ratchet wrench capable of being used in one hand as set forth in claim 2, wherein a movable hole in communication with the inner hole is defined in the side wall of the handle, the propelling head passes through the movable hole and is arranged outside the handle.

4. A rapid ratchet wrench capable of being used in one hand as set forth in claim 2, wherein the control mechanism comprises a top shaft and a positioning mechanism, wherein the tensioner head is mounted on a top end of the top shaft, wherein the positioning mechanism is mounted on a rear part of the top shaft, wherein the position of the tensioner head is operative to be secured by the positioning mechanism, so that the tensioner head is operative to be positioned.

5. A rapid ratchet wrench capable of being used in one hand as set forth in claim 4, wherein the positioning mechanism is a ratchet retractable mechanism comprising a pressing head, a rotating head, a guide strip and a return spring, wherein the rotating head is joined to the top shaft, the return spring is sleeved on the top shaft, with one end of the return spring abutting against the body of the handle and the other end against a block bar disposed on the top shaft, wherein the propelling head is arranged on the pressing head.

6. A rapid ratchet wrench capable of being used in one hand as set forth in claim 5, further comprising an inner sleeve disposed in the inner hole, wherein the guide strip is arranged on an inner wall of the inner sleeve, a front end of the inner sleeve is provided with a hole allowing the top shaft to pass through and be partially inserted into the sleeve hole, and the pressing head and rotating head are inserted in the inner sleeve.

7. A rapid ratchet wrench capable of being used in one hand as set forth in claim 6, wherein a screw hole in communication with the inner hole is defined in the handle, and a positioning bolt configured to secure the inner sleeve is mounted in the screw hole.

8. A rapid ratchet wrench capable of being used in one hand as set forth in claim 3, wherein the control mechanism comprises a top shaft and a positioning mechanism, wherein the tensioner head is mounted on a top end of the top shaft, wherein the positioning mechanism is mounted on a rear part of the top shaft, wherein the position of the tensioner head is operative to be secured by the positioning mechanism, so that the tensioner head is operative to be positioned.

9. A rapid ratchet wrench capable of being used in one hand as set forth in claim 8, wherein the positioning mechanism is a ratchet retractable mechanism comprising a pressing head, a rotating head, a guide strip and a return spring, wherein the rotating head is joined to the top shaft, the return spring is sleeved on the top shaft, with one end of the return spring abutting against the body of the handle and the other end against a block bar disposed on the top shaft, wherein the propelling head is arranged on the pressing head.

10. A rapid ratchet wrench capable of being used in one hand as set forth in claim 9, further comprising an inner sleeve disposed in the inner sleeve, wherein the guide strip is arranged on an inner wall of the inner sleeve, a front end of the inner sleeve is provided with a hole allowing the top shaft to pass through and be partially inserted into the sleeve hole, and the pressing head and rotating head are inserted in the inner sleeve.

11. A rapid ratchet wrench capable of being used in one hand as set forth in claim 10, wherein a screw hole in communication with the inner hole is defined in the handle, and a positioning bolt configured to secure the inner sleeve is mounted in the screw hole.

* * * * *